US010420428B2

(12) United States Patent
Seljeseth

(10) Patent No.: US 10,420,428 B2
(45) Date of Patent: Sep. 24, 2019

(54) REGISTRATION AREA, LOADING AREA, AND PACKING AREA OF A CHECKOUT COUNTER, A CHECKOUT COUNTER AND A METHOD FOR OPERATION OF A ROUNDTABLE PACKING AREA OF A CHECKOUT COUNTER

(71) Applicant: PeoplePos Ltd., London (GB)

(72) Inventor: Kay Seljeseth, Baerums Verk (NO)

(73) Assignee: PEOPLEPOS LTD., London (GB)

( * ) Notice: Subject to any disclaimer, the term of this patent is extended or adjusted under 35 U.S.C. 154(b) by 0 days.

(21) Appl. No.: 14/439,835

(22) PCT Filed: Oct. 23, 2013

(86) PCT No.: PCT/IB2013/059561
§ 371 (c)(1),
(2) Date: Apr. 30, 2015

(87) PCT Pub. No.: WO2014/068446
PCT Pub. Date: May 8, 2014

(65) Prior Publication Data

US 2015/0272349 A1 Oct. 1, 2015

(30) Foreign Application Priority Data

Oct. 31, 2012 (NO) ..... 20121269

(51) Int. Cl.
*A47F 9/04* (2006.01)
*G07G 1/00* (2006.01)

(52) U.S. Cl.
CPC ..... *A47F 9/047* (2013.01); *A47F 9/04* (2013.01); *A47F 9/046* (2013.01); *G07G 1/0036* (2013.01); *A47F 2009/041* (2013.01)

(58) Field of Classification Search
CPC .. A47F 9/04; A47F 9/046; A47F 9/045; A47F 10/00; A47F 10/02;
(Continued)

(56) References Cited

U.S. PATENT DOCUMENTS 1,592,931 A * 7/1926 Fritsch ..... A47F 10/02 186/69
2,902,115 A 9/1959 McNeil et al.
(Continued)

FOREIGN PATENT DOCUMENTS

DE 321649 A * 11/1983 ..... A47F 10/00
NO 332543 10/2012
WO 2012/173490 12/2012

OTHER PUBLICATIONS

English Translation and Abstract of DE 3216149 A, published Nov. 3, 1983. (Year: 1983).*
(Continued)

*Primary Examiner* — Jeffrey A Shapiro
(74) *Attorney, Agent, or Firm* — Wenderoth, Lind & Ponack, L.L.P.

(57) ABSTRACT

The present invention discloses a checkout counter which includes loading areas, registration area and packing comprising; a loading area, a registration area comprising means for parallel checkout and registration of purchased goods where the means at least comprises; a first registration zone, a second registration zone, and at least one registration means adapted to register goods from the first and the second registration zone, and a packing area configured to receive goods from two registration zones in parallel. It is also disclosed a method for operation of a checkout counter according to one embodiment of the invention.

1 Claim, 8 Drawing Sheets

(58) Field of Classification Search
CPC ..... A47F 2009/041; A47F 9/00; A47F 9/02; A47F 9/042; A47F 9/043; A47F 2009/044; A47F 9/047; A47F 9/048; A47F 9/005; B65G 2812/14; B65G 47/80; B62B 1/266; G07G 1/0045; G07G 1/0036; G07G 1/00; G07G 1/0018
USPC ..... 160/238; 186/59–69; 235/383, 385
See application file for complete search history.

(56) References Cited

U.S. PATENT DOCUMENTS 2,978,069 A 4/1961 Shoffner
3,090,467 A 5/1963 Crawford
3,628,632 A * 12/1971 Lambert ..... A47F 9/043 186/66
3,651,890 A * 3/1972 Potrafke ..... A47F 9/045 186/68
3,656,587 A * 4/1972 Siegel ..... A47F 9/042 186/66
3,688,873 A * 9/1972 Werner Potrafke ..... A47F 9/04 186/59
3,690,411 A * 9/1972 Werner Potrafke ..... A47F 9/04 186/68
3,792,757 A * 2/1974 Musser ..... A47F 9/04 186/64
4,180,158 A * 12/1979 Frederick ..... A47F 9/04 186/67
4,265,335 A * 5/1981 Joseloff ..... A47F 9/04 186/63
4,330,048 A * 5/1982 Joseloff ..... A47F 9/042 186/66
4,392,553 A * 7/1983 Foster ..... A47F 9/04 186/61
4,401,189 A * 8/1983 Majewski ..... B65G 47/71 186/68
4,676,343 A * 6/1987 Humble ..... A47F 9/047 177/50
4,887,209 A * 12/1989 Sugishima ..... G06Q 20/202 705/21
4,953,664 A * 9/1990 Vrooman ..... A47F 9/042 186/59
5,019,694 A * 5/1991 Collins, Jr. ..... A47F 9/046 186/61
5,131,499 A * 7/1992 Hoar ..... B65B 67/04 186/66
5,154,260 A * 10/1992 Patel ..... A47F 10/02 186/55
5,178,234 A * 1/1993 Sakurai ..... A47F 9/04 186/61
5,311,969 A * 5/1994 Dickover ..... A47F 9/04 186/61
5,375,680 A 12/1994 Ikeda et al.
5,390,764 A * 2/1995 Kerber ..... A47F 9/046 186/68
5,412,191 A 5/1995 Baitz et al.
5,491,328 A * 2/1996 Rando ..... A47F 9/046 235/462.14
5,492,199 A * 2/1996 Shimoyama ..... A47F 9/046 186/61
5,515,944 A * 5/1996 Cappi ..... A47F 9/047 186/61
5,752,582 A 5/1998 Hayward
5,770,848 A * 6/1998 Oizumi ..... G06K 7/10831 235/383
5,884,728 A * 3/1999 d'Estaintot ..... A47F 9/04 186/62
6,540,137 B1 4/2003 Forsythe et al.
6,588,549 B2 * 7/2003 Wike, Jr. ..... A47F 9/046 186/61
6,729,242 B2 * 5/2004 Kerber ..... A47F 9/04 108/147.17
6,834,596 B2 * 12/2004 Kerber ..... A47F 9/046 108/42
7,048,184 B2 5/2006 Persky
7,114,650 B2 * 10/2006 Sherrod ..... G07F 11/24 235/381
7,127,706 B2 * 10/2006 Mason ..... G06Q 20/20 235/383
7,386,472 B1 * 6/2008 Bogat ..... G06Q 10/06 705/23
7,387,241 B2 * 6/2008 Hassenbuerger ..... A47F 9/046 235/381
7,434,663 B1 * 10/2008 Brosnan ..... A47F 9/047 186/68
7,648,066 B2 * 1/2010 Kangas ..... A47F 9/047 186/61
D621,633 S * 8/2010 Kaplan ..... D6/699
8,485,346 B2 * 7/2013 Redick ..... A47F 9/04 186/67
8,733,643 B2 * 5/2014 Svetal ..... G07G 1/0045 235/383
2002/0020585 A1 * 2/2002 Cernik ..... A47F 9/04 186/68
2007/0007078 A1 * 1/2007 Johnson ..... A47F 9/047 186/61
2007/0029165 A1 2/2007 Bender et al.
2007/0051561 A1 * 3/2007 Harris ..... A47F 9/04 186/59
2008/0121467 A1 * 5/2008 Morris ..... B66B 13/06 187/200
2008/0302607 A1 * 12/2008 Kaplan ..... A47F 9/04 186/61
2009/0090583 A1 * 4/2009 Bonner ..... G06Q 30/06 186/59
2009/0090584 A1 * 4/2009 Chakra ..... A47F 9/047 186/61
2009/0165665 A1 * 7/2009 Gunes ..... B61B 1/02 104/30
2010/0044157 A1 * 2/2010 Marshall ..... A47F 9/046 186/61
2010/0076855 A1 * 3/2010 Karnin ..... A47F 9/047 705/24
2010/0293861 A1 * 11/2010 Ting ..... E05B 47/026 49/394
2011/0147454 A1 6/2011 Matsuhisa et al.
2011/0253778 A1 10/2011 Kaplan et al.
2012/0005297 A1 * 1/2012 Robles Gil Daellenbach ..... G07F 9/02 709/208
2012/0197741 A1 8/2012 Carlegren et al.
2013/0291455 A1 * 11/2013 Wiegel ..... B65G 69/003 52/173.1

OTHER PUBLICATIONS

International Preliminary Report on Patentability dated May 12, 2015 in corresponding International Application No. PCT/IB2013/059561.
International Search Report dated Mar. 7, 2014 in corresponding International Application No. PCT/IB2013/059561.
Norwegian Search Report dated May 27, 2013 in corresponding Norwegian Application No. 20121269.

* cited by examiner

REGISTRATION AREA, LOADING AREA, AND PACKING AREA OF A CHECKOUT COUNTER, A CHECKOUT COUNTER AND A METHOD FOR OPERATION OF A ROUNDTABLE PACKING AREA OF A CHECKOUT COUNTER

TECHNICAL FIELD

The present invention relates to checkout counters and in particular to an embodiment of registration loading areas, registration areas and packing areas of checkout counters, it also relates to the operation of checkout counters according to the present invention.

BACKGROUND ART

A typical checkout counter (ref. FIG. 1) in use in retail stores includes a loading area, a registration area and a packing area. The loading area may be provided with conveyor belts which convey goods from the loading are and into the registration area. At the registration areas goods are traditionally registered by a cashier. The registration process may include the use of automatic scanning equipments such as bar code readers operated by the cashier. The next zone is the packing area; goods are either conveyed or manually fed from the registration area to the packing area.

Customers are often waiting for the cashier to register purchased items, hand out bags, handle additional sales and accept payments.

Recently self service checkout counters have been introduced. Their layout and design usually resembles that of the traditional checkout counter shown in FIG. 1. However the customer is then exchanged with the cashier and a payment zone/area is added. The customer then loads the goods into the loading area or directly into the registration area where the goods are registered. After all goods have been registered the customer swipes a debit card or credit card in a card reader thereby finishing the transaction process between the goods provider and himself.

A problem with a complete self service system is among others that the customer often needs help to understand the system if anything irregular happens he needs to get in contact with a cashier or service staff from the retailer. Also some kind of control may be necessary so as to prevent erroneous registrations or to prevent deliberate fraud.

It is known a check out device from U.S. Pat. No. 5,492,199 A the check out device includes a first and second scanning lanes set in parallel with each other, each for reading an article code affixed to an article which is moved from an upstream side to a down stream side in a corresponding scanning lane.

Moreover it is known from U.S. Pat. No. 6,540,137 B1 a checkout terminal which provides self service registration of goods as well as operator registration of goods by reconfiguring the checkout terminal between the two modes, i.e. self service and operator driven.

US 2009/0090584 A1 discloses a solution for providing item bagging advisements to baggers.

U.S. Pat. No. 5,752,582 disclose a checkout station which allows a single cashier to assist multiple customers simultaneously.

It is an object of the present invention to overcome the drawbacks of the systems indicated above.

DISCLOSURE OF INVENTION

It is one object of the invention to provide a technical solution to increase the capacity in a checkout counter by allowing customers to register, select, weigh or scan (hereafter register/registration) purchases entirely or partly on their own and then in combination with, or separately and simultaneously with the registrations, carry out payment processing and other tasks the cashier is engaged with.

More particularly the present invention discloses a registration area of a checkout counter, comprising means for independently parallel checkout and registration of purchased goods where the means at least comprises:

- a first registration zone,
- a second registration zone adjacent and parallel with the first registration zone (306), and
- at least one registration means adapted to register goods from the first and the second registration zone simultaneously or substantially simultaneously. Where the registration area of the checkout counter further comprises:
- a first registration means adapted to register goods from the first registration zone, and
- a second registration means adapted to register goods from the second registration zone. Moreover according to one aspect of the invention the first registration zone includes a first scale and/or the second registration zone includes a second scale.

In yet an aspect of the invention the first and the second registration zone comprises driving means for conveying goods. According to one aspect of the invention the driving means are provided as rollers in the first and the second registration zone adapted to facilitate transport of goods.

In yet an aspect of the invention the registration means includes at least one of:

a barcode scanner, an RFID-scanner and optical/visual recognition devices.

According to the present invention it is also provided a loading area of a checkout counter, where the loading area according to one aspect of the invention is configured to communicate with the registration area of the checkout counter. In particular it is provided an embodiment for a loading area which comprises a rotatable roundtable disc with at least one barrier arranged radially from the centre of the disc where the at least one barrier is adapted to rotate together and/or independently with the rotatable disc, and where the loading area is configured to forward goods downstream to two registration zones in parallel.

According to the present invention it is also provided a packing area of a checkout counter, where the packing area according to one aspect of the invention is configured to communicate with the registration area. The packing area of a checkout counter is specified in that the packing area comprises a rotatable disc with at least one barrier arranged radially proximately from the centre of the disc where the at least one barrier has a length that is less than the radius of the rotatable disc and where the at least one barrier is adapted to rotate together with the rotatable disc and/or independent of the rotatable disc, and where the packing area is configured to receive goods from two registration zones in parallel. Where optionally the packing area is configured to receive goods from two registration zones in parallel.

In an aspect of the packing area of the checkout counter the packing area comprises at least one packing zone barrier sensor and/or activator, arranged to sense if a barrier is present in a sensor position.

In yet another aspect of the invention the packing area of the checkout counter is specified in that the packing area comprises a rotatable disc arranged with four barriers arranged radially from the centre or proximately to the centre of the disc where the four barriers are adapted to rotate synchronously and/or together with the rotatable disc as well as independently of the disc around the centre or proximately the centre of the disc.

Finally it is provided a complete checkout counter which includes loading areas, registration area and packing area according to the above. In particular it is provided a checkout counter comprising:

a loading area configured to forward goods downstream to a registration area comprising two registration zones, the registration area comprising means for parallel checkout and registration of purchased goods where the means at least comprises:

a first registration zone, a second registration zone, and at least one registration means adapted to register goods from the first and the second registration zone, and a packing area configured to receive goods from the two registration zones.

According to one embodiment of the checkout counter the loading area comprises a rotatable roundtable disc with at least one barrier arranged radially from the centre of the disc. Moreover according to one aspect of the invention the packing area comprises a rotatable disc with at least one barrier arranged radially from the centre of the disc. In another embodiment of the checkout counter the packing area comprises substantially plane area designed as a parallellepiped with one barrier pivotably arranged at the centre or substantially in the centre of one end of the packing area. In this embodiment the barrier can be moved between three positions and the barrier are pivotably connected to the remote end of the packing area or the barrier are connected to the near side of the packing area.

In one aspect of the invention the checkout counter is specified in that sensors provides position data for barriers to a computer system.

It is also disclosed a method for operation of a checkout counter according to one embodiment of the invention, where said method comprises the steps of:

a) to transport item to a shared zone of the roundtable, b) check if ongoing sale is complete, and if so continue at point c), and if not continue at point d c) move barrier from sensor point to the opposite position, continue with point g, d) check if customer has completed his registrations, and if so continue at point e), and if not continue at point b e) move customer side barrier to centre position, the cashier continues registering items, f) check if ongoing registration from cashier is complete, if not continue with point e, if yes continue with point c, and g) continue with a new customer repeating the steps a-g.

Other advantageous features will be apparent from the accompanying claims.

BRIEF DESCRIPTION OF DRAWINGS

Following is a brief description of the drawings in order to make the invention more readily understandable, the discussion that follows will refer to the accompanying drawings, in which.

MODE(S) FOR CARRYING OUT THE INVENTION

Figure 1:
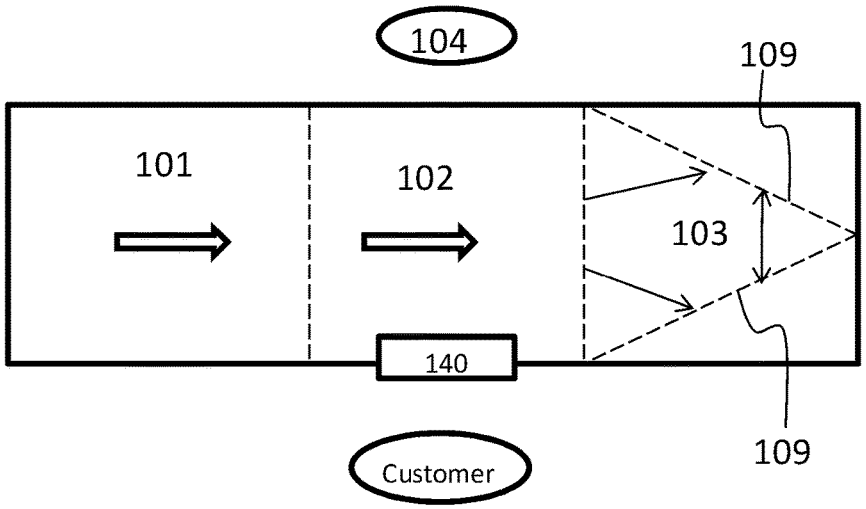
FIG. 1 shows a prior art checkout counter.
Figure 2:
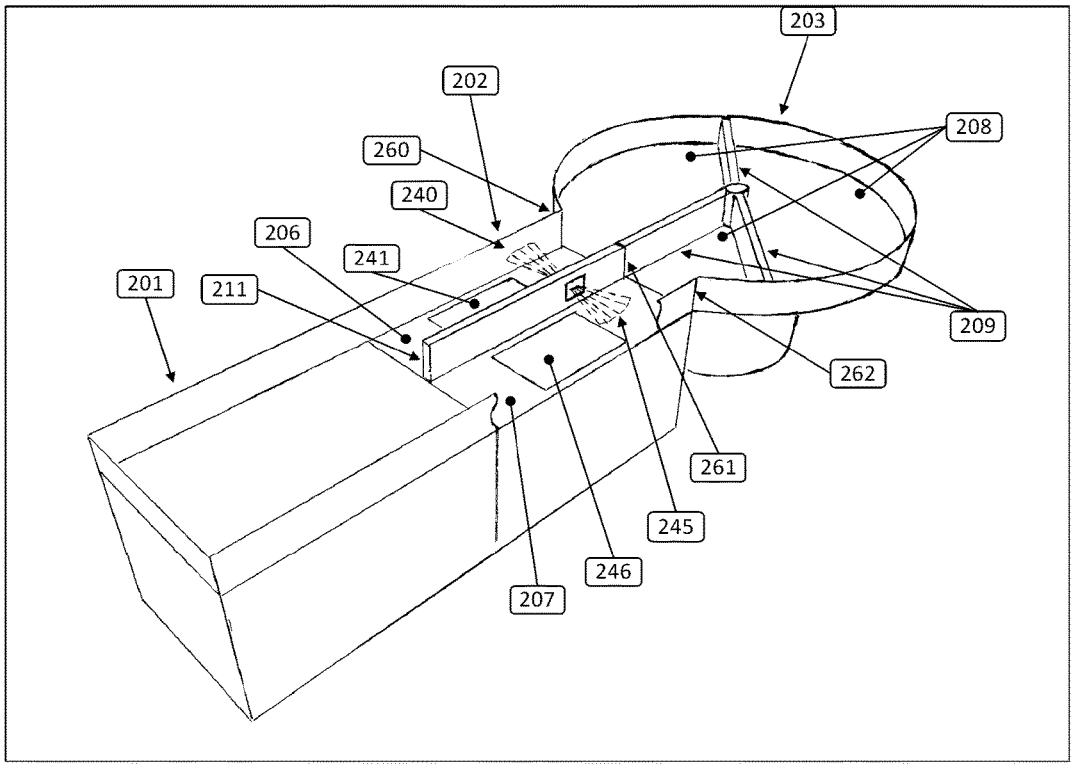
FIG. 2 shows a general view of a checkout counter according to the present invention.

In the following it is firstly disclosed general embodiments in accordance to the present invention, thereafter particular exemplary embodiments will be described. Where possible reference will be made to the accompanying drawings and where possible using reference numerals in the drawings. It shall be noted however that the drawings are exemplary embodiments only and other features and embodiments may well be within the scope of the invention as described.

In the following description it will be adhered to the definitions below:

Cashier, by a cashier it is meant any person that operates the checkout counter and is responsible for the cashier terminal during expedition of customer goods.

Customer, the customer shall be interpreted as any person which have the intention of purchasing goods and which brings the goods to a checkout counter according to the present invention.

Checkout counter, and counter is used interchangeably throughout the description. The terms shall be understood as the complete check area for checking out goods that is the loading area, the registration area including any cash register and the packing area.

Scale, by scale it shall be understood any scale being a part of a checkout counter which is configured for weighing goods that shall be checked out by the checkout counter. Any input from these are read into a computer system and registered into the applicable zone according to the computer system state and logic.

Registration means, by registration means it shall be understood any means adapted to register goods. Typical examples include bar code scanners, RFID-readers or optical/visual recognition devices. The registration means may be configured to scan/register goods in a plurality of direction; this can be facilitated by using a rotating scanning head, RFID-reader and/or optical registration unit(s). Any input from these are read into a computer system and registered into the applicable zone according to the computer system state and logic.

Loading area, the loading area is defined as the area in which customers place goods to be purchased.

Cashier screen, this is the primary information source for the cashier, where the cashier may see the registration status, barrier sensor status, the sales line per sale/registration, the payment status and any counter system information needed to control and operate the counter. The screen may be a touch screen, allowing combined visual screen output and touch input against the screen. The touch input may be used instead of, or in addition to the cashier keyboard/input device(s). The screen should be directed towards the cashier in such a way that it is easy visible and also reachable in the case of a touch screen. Other output information may be given using light signals, audible output and other known means of human interaction.

Cashier keyboard/input devices: The functions supported by the cashier keyboard and input device(s) will be the same as for any typical point of sale/counter computer system keyboard/input. In addition the keyboard and/or cashier input device(s) will support features for controlling the registration in the applicable zones, open and close sales, control the barrier(s), perform customer zone assistance, perform customer zone registrations on demand and allow the cashier to control the system as required.

Customer screen: This is the primary information source for the customer, where the customer may see the registration status for the ongoing sale, the sales lines, the payment status and other information required by the customer to perform registrations according to the state of the system in the customer zone. Typically the screen may inform the customer that registrations may be performed, a registration has been accepted, a registration needs to be done by the cashier, a registration is paused/denied due to regulatory conditions or that the zone used is closed. The screen may be a touch screen, allowing combined visual screen output and touch input against the screen. The touch input may be used instead of, or in addition to the cashier keyboard/input device(s). The screen should be directed towards the customer in such a way that it is easy visible and also reachable in the case of a touch screen. Other output information may be given using light signals, audible output and other known means of human interaction.

Customer keyboard/input devices: The keyboard and/or customer input device(s) will support features for supporting the customer registration process in the customer zone, like to confirm or select options needed to be input to the computer system.

Packing zone barrier sensors/activators: The computer system may execute operational control from knowing the position of the barriers at any time of the processing. The sensors may through the means of known technology like magnetic switches, micro switches, optical sensors or other means detect if a barrier is present in a sensor position, what barrier is present or if it has been moved passed the sensor position and then in what direction.

Banking terminal: One or more banking terminals may be attached to the computer system to facilitate integrated payment operations. These may be customer self-service operated and/or cashier operated according to the implementation desired.

According to embodiments of the present invention it comprises three areas as is common in checkout counters today, but differs in the way the centre area 202 is designed and according to embodiments in how the packing area 203 and loading area 201 is designed. The centre area is the registration area which in addition to the typical cashier's registration means is provided with a second parallel registration zone 207 that can be used by the customer in such a way that they can independently register their own goods against their own purchases.

The registration area can be built up with one or two roller paths or conveyor belts. These may be operating freely or synchronously between the customer and cashier. Any feed mechanism may be controlled manually or via a computer system, typically referred to as the Point Of Sale (POS) system.

The registration area is designed to transmit item registrations from each of two fields into each of their ongoing purchase registrations, or to combine the registrations into a single purchase, into a POS system or in such a way that one or more zones can be in a payment queue after they are completely registered. This enables the registration process to continue with one or more outstanding payments related to purchases in the packing area.

The checkout counter can be fitted with a turntable packing area 203, which allows for multiple purchases to accumulate in zones 208 according to the output from the registration area 202. The turntable packing area 203 may have zones 208 of varying/flexible size in order to be adaptable to varying package volumes per purchase. Also, the position of these zones can be read into the POS system so that the registration/scanning process is stopped or only allowed into the correctly set zone, based on zones positioned against the registration area and the respective detection zones.

The payments may be self-serviced or performed as any common payment performed by the cashier. For example, a customer could pay his buy/zone with their payment cards on their own, while another customer pays for his purchases/zone to the cashier.

According to one embodiment of the invention it is provided a POS system that can simultaneously manage sales for at least the number of concurrent checkout zones that the counter is physically built to handle. The cashier will through the POS system have full overview of all the zones, any ongoing registrations per zone and any ongoing or closed sales and payments. The cashier may also according to desired security settings verify, change or delete registrations made per zone.

The POS system may have logic for random control of customer registrations per an arbitrary number of registrations to reduce the risk of fraud and erroneous registrations, in the same way as common in so-called self-scanning checkout solutions. Also regulatory controls can be made, like verifying the customer's age when needed and for limiting sales outside an allowable time period.

The first area, called the "loading" area 201 may according to one embodiment be designed as a rotatable unit or roundtable disc which physically resembles a rotatable disc in the packing area 203 or be single rollers based or use conveyor belt. The loading area 201 is directly in communication with the registration area 202 registration zones 206, 207.

First Embodiment of the Registration Area

Figure 3:
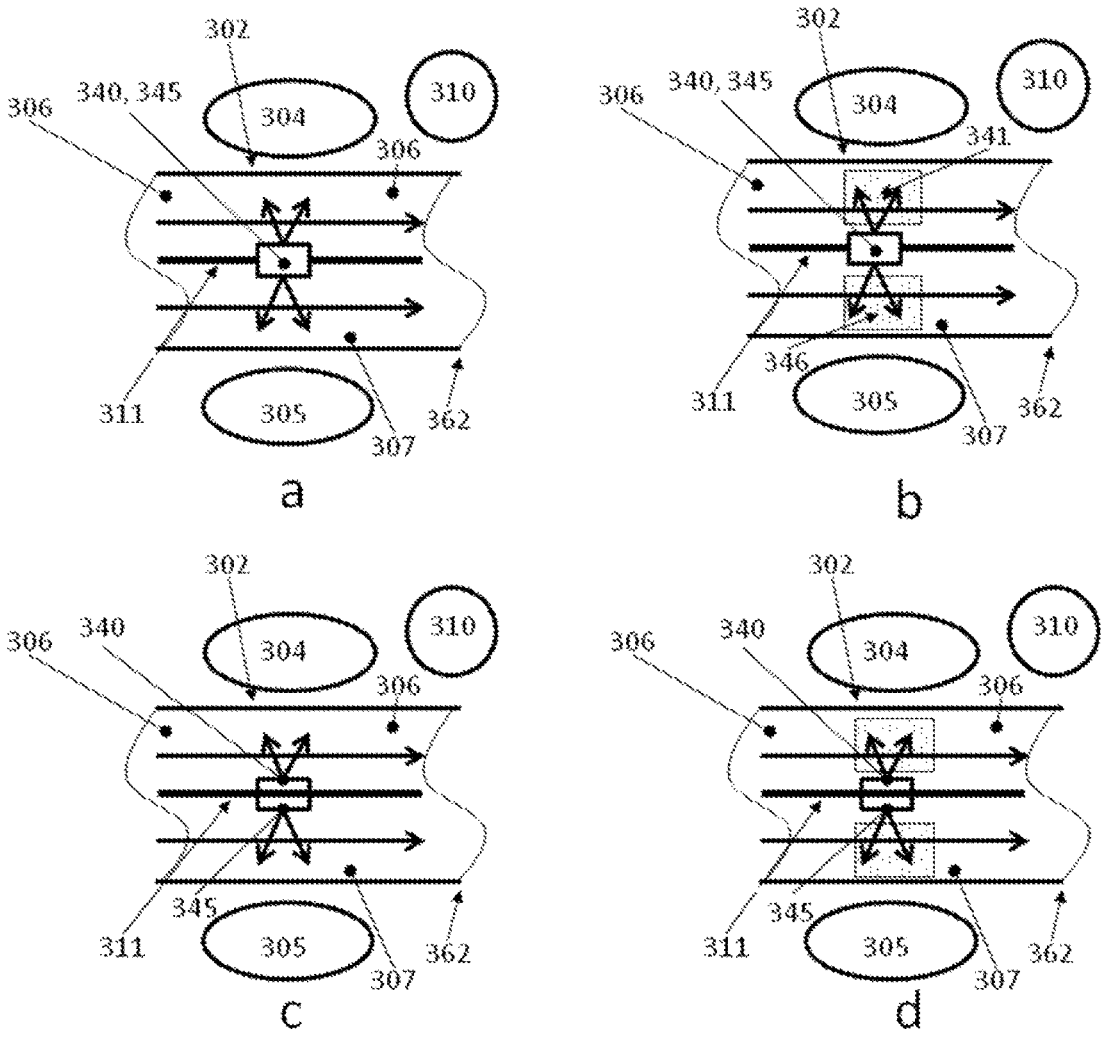
FIG. 3*a-d* shows embodiments of registering zones according to the present invention.

The first embodiment (FIG. 3*a*) of the registration area discloses a registration area 302 of a checkout counter with parallel processing of goods including two adjacent and parallel registration zones 306, 307 and one registration means adapted to register goods in both registration zones 306, 306 simultaneously or substantially simultaneously.

Second Embodiment of the Registration Area

According to a second embodiment (FIG. 3*b*) of the present invention the registration area 302 according to the first embodiment of the registration zone is provided with at least one scale 341, 346.

Third Embodiment of the Registration Area

The third embodiment (FIG. 3*c*) of the registration area discloses a registration area of a checkout counter with parallel processing of goods including two adjacent and parallel registration zones 306, 307 and two registration means 340, 345 adapted to register goods in both registration zones simultaneously or substantially simultaneously.

Fourth Embodiment of the Registration Area

According to a fourth embodiment (FIG. 3*d*) of the present invention the registration area 302 according to the third embodiment of the registration area is provided with at least one scale 341, 346.

First Embodiment of the Packing Area

Figure 4:
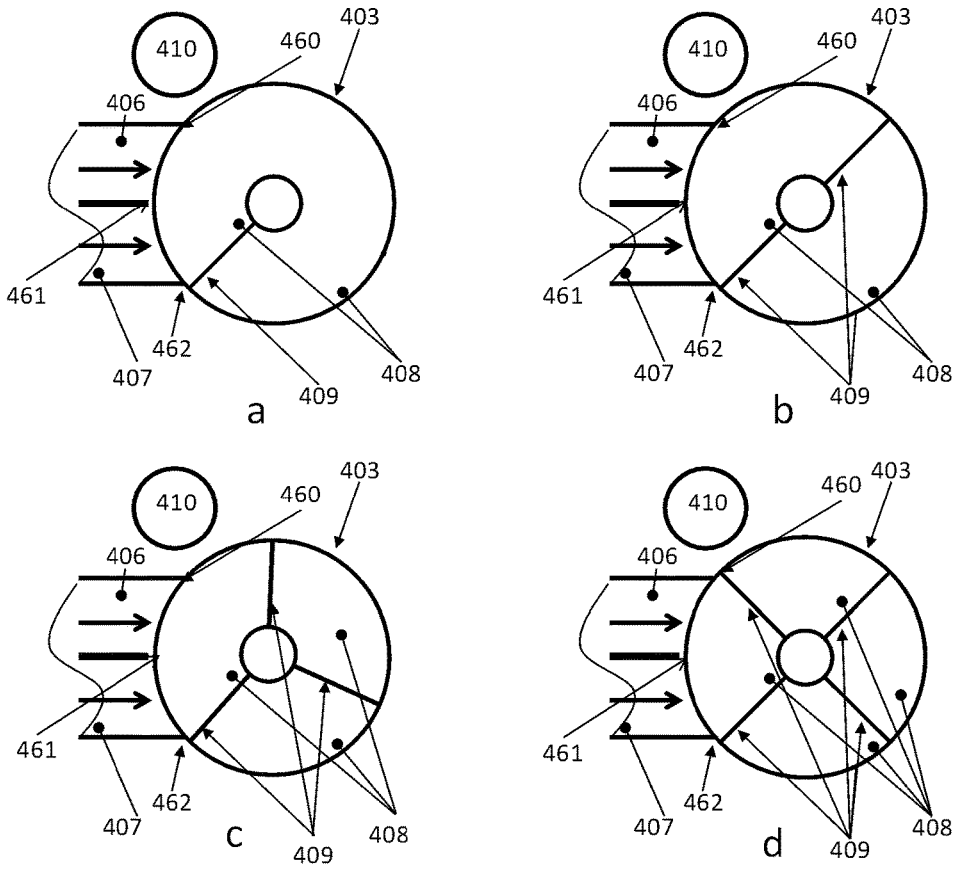
FIG. 4*a-d* shows embodiments of packing area with a roundtable according to the present invention.

The first embodiment (FIG. 4*a*) of the packing area discloses a packing area 403 of a checkout counter with parallel processing of goods including a rotatable disc a so called turntable packing area arranged with one barrier 409 arranged radially from the centre or proximately to the centre of the disc. The one barrier 409 is adapted to rotate synchronously and/or together with the rotatable disc as well as independently of the disc around its axis of rotation i.e. the centre or proximately the centre of the disc. It shall be noted that the packing area is configured to receive goods from two registration zones (306, 406, 307, 407) in parallel.

Second Embodiment of the Packing Area

The second embodiment (FIG. 4*b*) of the packing area discloses a packing area 403 of a checkout counter with parallel processing of goods including a rotatable disc arranged with two barriers 409 arranged radially from the centre or proximately to the centre of the disc where the two barriers 409 is adapted to rotate synchronously and/or together with the rotatable disc as well as independently of the disc around its axis of rotation i.e. the centre or proximately the centre of the disc. According to one aspect of the second embodiment of the packing area the two barriers 409 are parallel and arranged radially from the centre or proximate to the centre of the disc in opposite directions.

Third Embodiment of the Packing Area

The third embodiment (FIG. 4*c*) of the packing area discloses a packing area 403 of a checkout counter with parallel processing of goods including a rotatable disc arranged with three barriers 409 arranged radially from the centre or proximately to the centre of the disc where the three barriers 409 is adapted to rotate synchronously and/or together with the rotatable disc as well as independently of the disc around its axis of rotation i.e. the centre or proximately the centre of the disc. The angle between the barriers 409 will typically be 120°.

Fourth Embodiment of the Packing Area

The fourth embodiment (FIG. 4*d*) of the packing area discloses a packing area 403 of a checkout counter with parallel processing of goods including a rotatable disc arranged with four barriers 409 arranged radially from the centre or proximately to the centre of the disc where the four barriers 409 is adapted to rotate synchronously and/or together with the rotatable disc as well as independently of the disc around its axis of rotation i.e. the centre or proximately the centre of the disc. The angle between the barriers 409 will typically be 90°. However, according to aspects of the fourth embodiment the angle between barriers may vary as the barriers may move independently of the rotatable disc and hence the angle between adjacent barriers may vary. A solution with four barriers may for example include the angles 180°, 60°, 60° and 60°. Hence the angle between to neighbouring barriers may be 180° or 60°.

The person skilled in the art will realise that the number of barriers may exceed four.

Fifth Embodiment of the Packing Area

Figure 5:
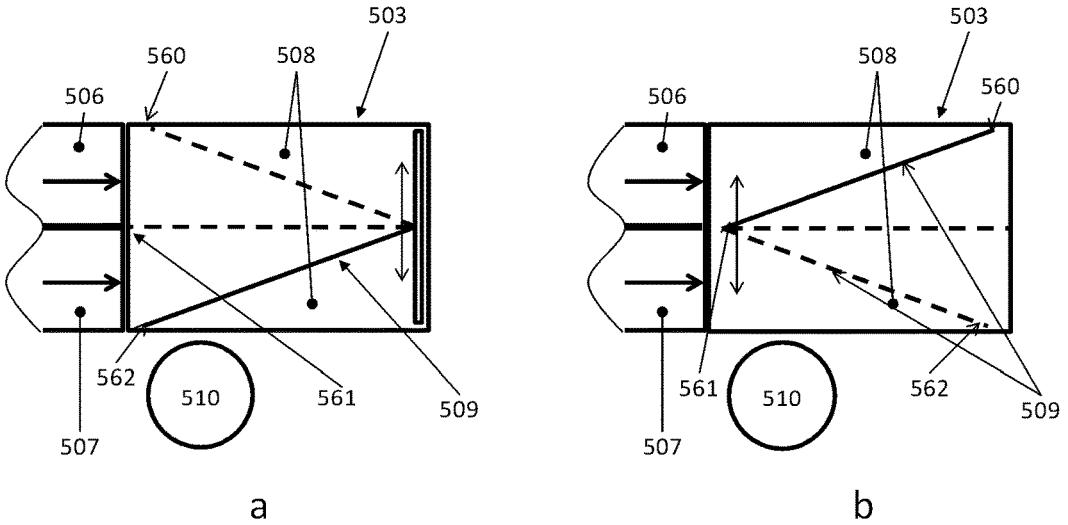
FIG. 5*a-b* shows embodiments of packing area with a standard configuration according to the present invention.

The fifth embodiment (FIG. 5*a-b*) of the packing area discloses a packing area 503 of a checkout counter with parallel processing of goods. This embodiment is often referred to as a standard packing area. The packing area according to this embodiment is designed as a parallellepiped. The packing area comprises one barrier 509 pivotably arranged at the centre or substantially in the centre of one end of the packing area. The barrier is adapted to divide the packing area into two zones, where the border of the zones will depend on the position of the barrier. Typically the barrier may be moved between three position which will give three different configured packing zones for the barrier pivotably connected to the remote end of the packing area (FIG. 5*a*) and three for a barrier connected to the near side (FIG. 5*b*) of the packing area respectively. The nearside of the packing area is the part of the packing area which is adjacent to the registration area, and the remote end of the packing area is the end which is farthest from the registration area.

According to the invention each single embodiment of the registration area may be combined with any embodiment of the packing area.

A First Embodiment of the Loading Area

Figure 6:
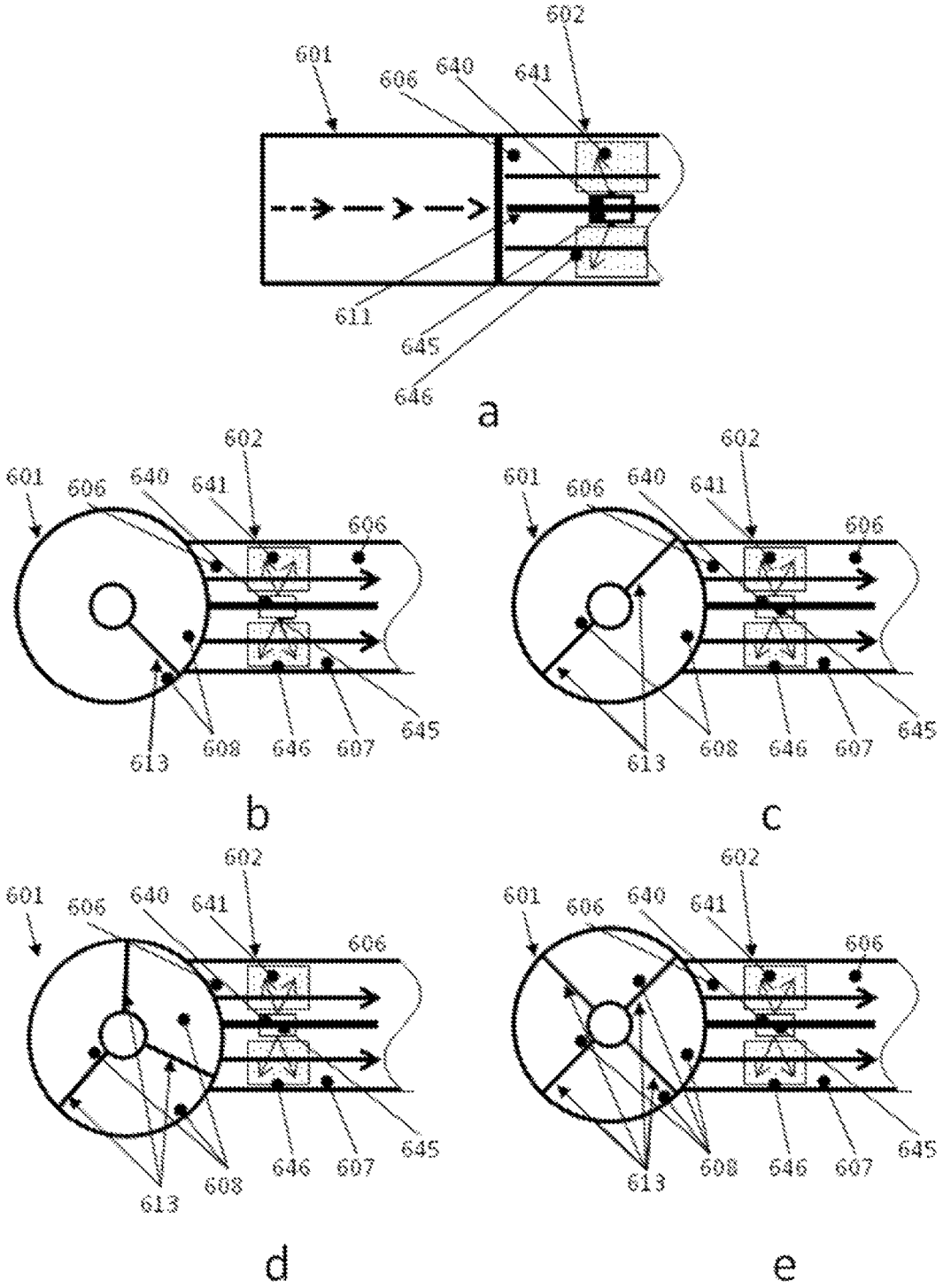
FIG. 6*a* shows embodiments of loading area with a standard configuration according to the present invention.
FIG. 6*b-e* shows embodiments of loading area with a roundtable according to the present invention.

According to a first embodiment (FIG. 6*a*) of the loading area 601, the loading area is a surface with a perimeter that is substantially a parallelepiped. The perimeter of the surface may be provided with sidewalls running along at least one side of the perimeter of the parallelepiped shaped surface. In one embodiment the sidewall runs along all sides of the surface apart from a part of the surface which is arranged adjacent to the registration area.

The loading area may be provided with rollers or one or two conveyor belts.

A Second Embodiment of the Loading Area

According to a second embodiment (FIG. 6*b-d*) of the loading area 601, the loading area is provided with a disc which resembles that of the first (FIG. 6*b*), second (FIG. 6*c*), third (FIG. 6*d*) and fourth (FIG. 6*e*) embodiment of the packing area. It may also be provided as a disc without any barrier. The perimeter of this embodiment is substantially circular.

According to one aspect of the second embodiment of the loading area the barriers are pivotably movable around its axis of rotation independent of the disc. Moreover, as further discussed elsewhere the barriers may be provided with sensors and the turntable with activators which are configured to interact with the barriers so as to facilitate or prevent movement of the barriers 613 and/or the roundtable disc.

The person skilled in the art will realise that configurations with a number of barriers as described with respect to the packing area may also be utilised for the loading area.

The person skilled in the art will realise that all embodiments of the loading, registration and packing areas may be combined into one checkout counter according to the present invention. It shall be noted that the loading area is configured to forward goods downstream to two registration zones (306, 406, 307, 407) in a registration area in parallel.

Operation of a Checkout Counter System According to the Present Invention

Figure 7:
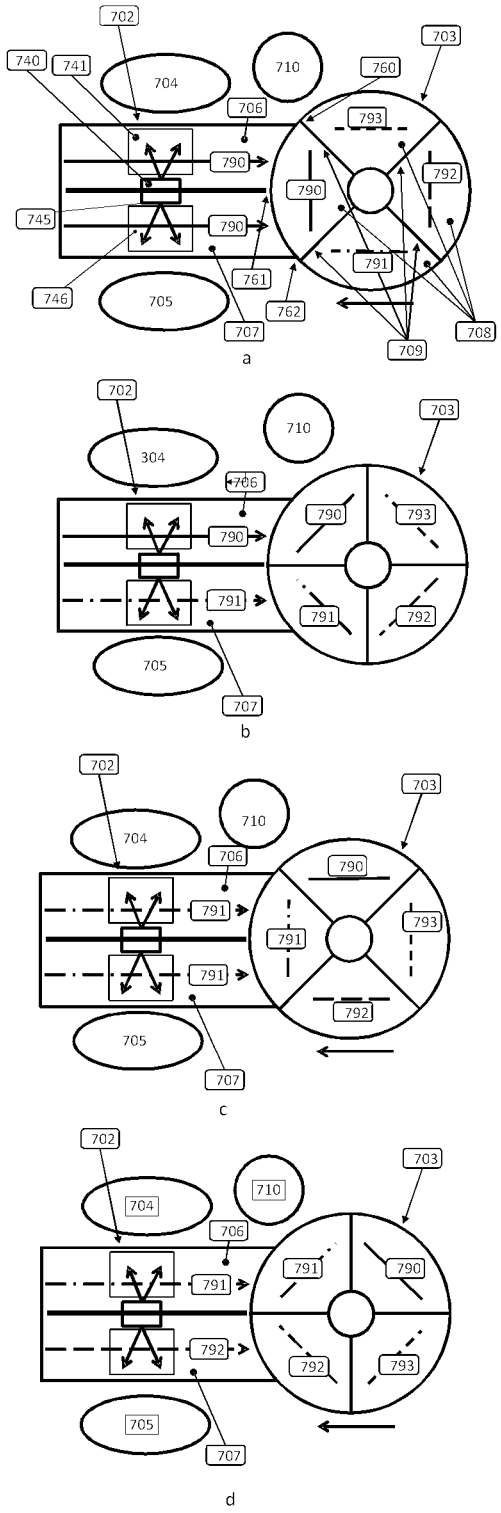
FIG. 7*a-d* shows operation of the packing area utilizing a roundtable according to embodiments of the present invention.

Above the mechanical bodies that provides a checkout counter with parallel or semi parallel processing of goods carried out by a customer and a cashier has been described. Below follows a brief explanation of the operation of the packing area both in a roundtable version (FIG. 7) and with a configuration with one single pivotably movable barrier.

Initial Procedure of Operation of a Checkout Counter System with a Turntable Packing Area On Counter system start-up, a computer system 919 will first determine from its configuration settings if there are movable barrier(s) 709 in the packing area 703 that is to be controlled. If so, the computer system 919 will check if the position(s) of the barrier(s) 709 are possible to read from the sensor(s) 760, 761, 762. If not it will ask the cashier 704 to move the barrier(s) 709 into readable positions in order for the computer system 919 to read the state of the barrier(s) 709.

When the reading utilized by the use of micro switches, magnetic switches or similar technology is properly confirmed the computer system 919 will according to one embodiment send signals to the activation units 760, 761, 762 to prevent the barriers from being physically moved, by having a magnetic solenoid lever/pin or other activation mechanism ensuring that the barrier(s) cannot be moved in a direction that may change the registration zone 706, 707 to packing zone 708 relationships.

For a turntable packing area this means that a barrier 709 with one end adjacent to the customer sensor position 762 only should be possible to move counter-clockwise to increase the size of the packing zone, a barrier 709 in contact with or adjacent to the cashier sensor position 760 should only be possible to move in a clockwise direction to increase the size of the packing zone. There should be no barrier(s) 709 in between the two barriers which are close to the customer sensor position 762 and the cashier sensor position 760 to complete the Counter start-up sequence.

Figure 8:
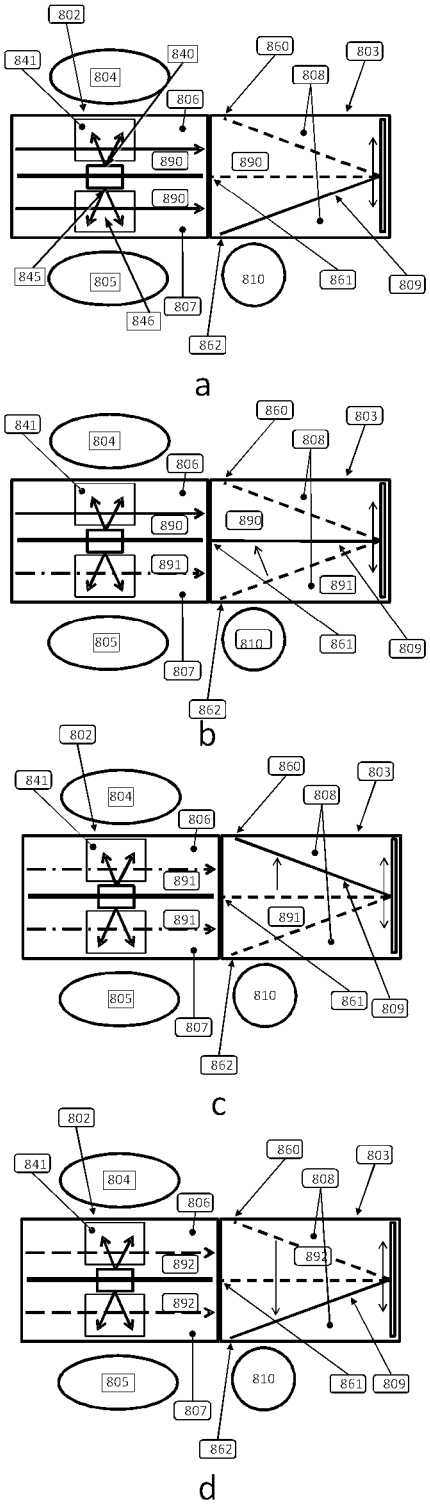
FIG. 8 shows operation of the packing area utilizing a standard packing area configuration according to embodiments of the present invention.
Figure 9:
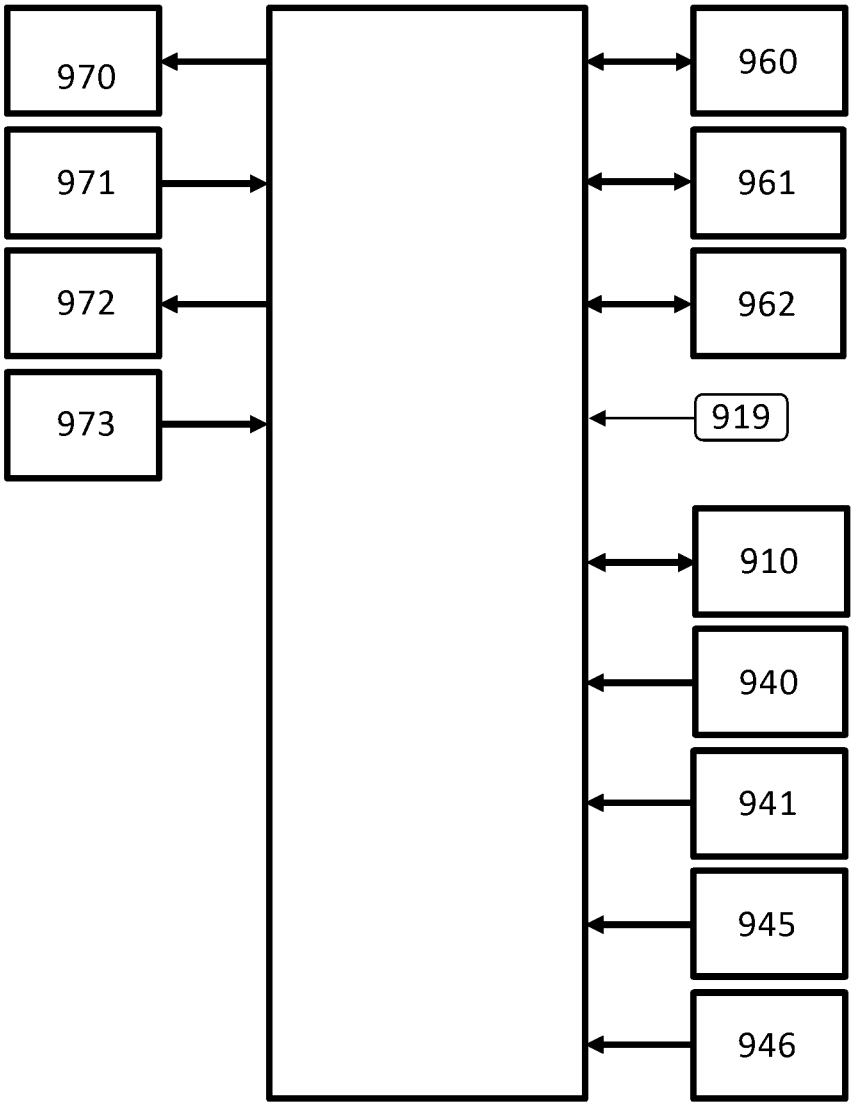
FIG. 9 shows I/O devices, electronic devices and registering devices in communication with a computer system according to one embodiment of the present application.

Initial Procedure of Operation of a Checkout Counter System with a Standard Packing Area For a standard packing area embodiment (FIG. 8) the barrier 809 may be in either of the outer sensor readable positions 860, 862, and the system will according to one embodiment lock the barrier 809 fully in that position. In FIG. 8 the barrier is shown in the customer sensor position 862 in order to ease the continued description herein.

Running Operation of a Checkout Counter System with a Turntable Packing Area

When the computer system 919 has completed the startup sequence the counter is ready for registering sales. From startup a simultaneous registering operation where both the cashier 704 and the customer 705 are registering into the same zone 708 is assumed to allow for a predictable operation after each startup.

The counter system is ready for combined registering zones 706, 707 scanning sequence after startup. As shown in figure FIG. 7*a* both the cashier registering zone 706 and the customer registering zone 707 may both scan 740, 745 or weigh 741, 746 purchased items and then place the items in the shared packing zone area, indicated by the three solid line indicators 790. As indicated above the process may deviate somewhat if there is only provided one scale or no scale at all. In the latter circumstance goods will normally already have been weighted or given a price. There may also be cases where the customer due to legislative reasons is not allowed to take part in the registration process.

At any time the cashier 704 may decide to close the ongoing combined sale in both registering zones 706, 707 or to close only the ongoing part of the sale in the customer registering zone 707.

If the cashier 704 closes the combined sale the computer system 919 will stop accepting any registrations and release the customer side barrier 709 lock 762 allowing the barrier 709 to be moved clockwise until its position is at the cashier side barrier 709 lock 760, thereby effectively changing to a new packing area zone 708 allowing a new combined sale to be started from both registering zones 706, 707 and then items registered will be placed into this new packing area as indicated by the three dash-dotted lines 791 in FIG. 7*c*.

Alternatively the cashier 704 may decide to close the ongoing sale only in the customer zone 707. The computer system 919 will then stop accepting registrations in the customer registering zone 707 and release the customer side barrier 709 lock 762 allowing the barrier 709 to be moved clockwise until its position is at the centre barrier 709 lock position 761, where the barrier 709 is locked in a fixed position thereafter allowing a new customer to start registering items in the customer zone 707 and place registered items in the next packing area zone 708 as indicated by the two dash-dotted lines 791 in FIG. 7*b*. During this state the cashier 704 may simultaneously continue to register items into the same zone as indicated by the two solid lines 790 indicated in FIG. 7*b*.

After the cashier 704 has completed a split sale in the cashier registering zone 706 as indicated in FIG. 7*b*, this sale may be closed and then the computer system 919 will stop accepting any registrations in the cashier registration zone 706 and release the barrier 709 in the centre position 7'61 allowing the barrier 709 to be moved clockwise until its position is in the cashier side barrier 709 lock position 760, thereafter allowing the cashier 704 to join in registering items in a combined sale with the ongoing sale the customer 705 was enduring in the customer zone 7'07, where all items registered will be placed into the same packing area as indicated by the three dash-dotted lines 791 in FIG. 7*c*.

The barrier may in an embodiment of the present innovation not be locked physically by the computer system, and may be operated freely. The computer system should then by reading barrier position sensors either pause/stop sales as required when an illegal position or move is detected, or at least give the cashier 704 and/or the customer 705 a visible and/or audible warning message indicating the illegal state of the barrier.

Figure 10:
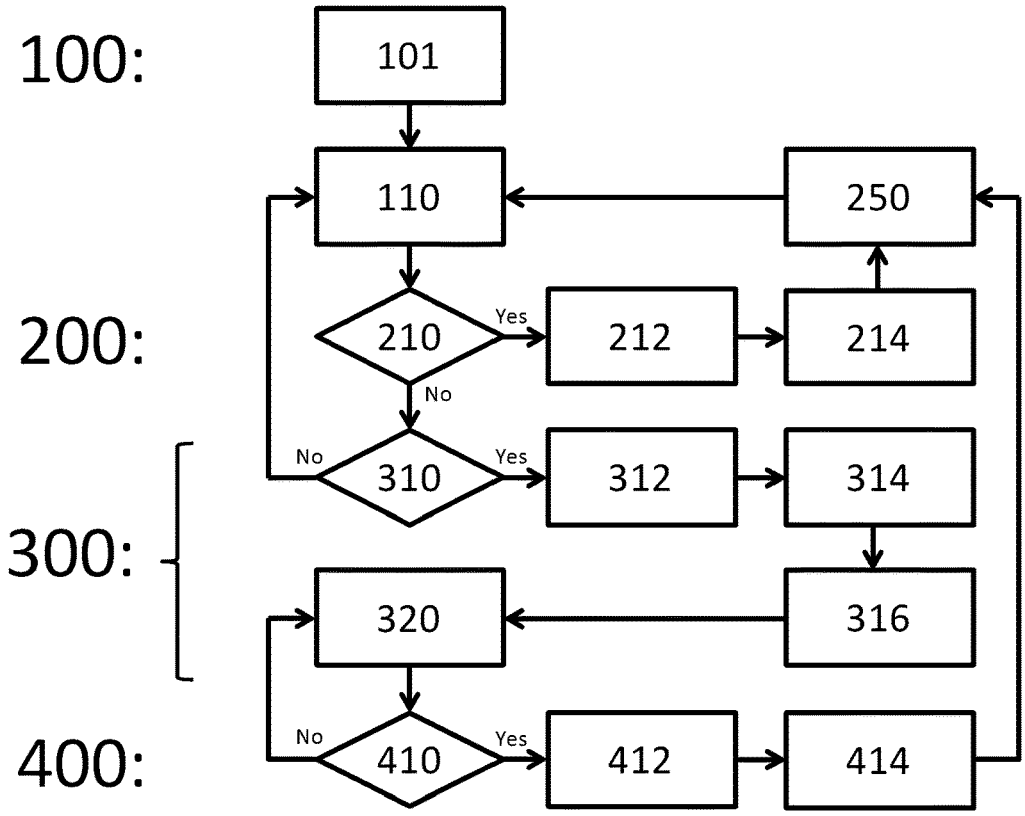
FIG. 10 shows a flow chart for operation of a checkout counter according to one aspect of the invention.

The running operation of the checkout counter with a roundtable disc shown step by step is disclosed in FIG. 10, it includes at least the following steps:

100: Start up condition; assumes sale to 790 as shown in FIG. 7*a*.

101: Start up/ready

110: Register items to shared zone 708.

200: Cashier closes the combined sale in customer and cashier zones going from configuration shown i FIG. 7*a* to that in FIG. 7*c*.

210: Complete sale? If yes continue with 212, if no continue with 310.

212: Close combined sale in both zones 706, 707.

214: Release customer side barrier 762.

250: Wait for barrier to be moved to cashier position 760.

300: Cashier closes the sale in the customer zone 707 going from configuration shown i FIG. 7*a* to that in FIG. 7*b*

310: Complete customer zone? If yes continue with 312, if no continue with 110.

312: Close sale in customer zone 707.

314: Release customer side barrier 762.

316: Wait for barrier to be moved to centre position 761.

320: Register items to split zone(s) 708 (FIG. 7*b*).

400: Cashier closes the cashier zone sale and combines this into the customer zone 707 going from configuration shown i FIG. 7*b* to that in FIG. 7*c*.

410: Complete cashier zone? If yes continue with 412, if no continue with step 320.

412: Close sale in cashier zone 706.

414: Release centre barrier 761.

Running Operation of a Checkout Counter System with a Standard Packing Area

The counter system is ready for combined registering zones 806, 807 scanning sequence after startup. As shown in FIG. 8 both the cashier registering zone 806 and the customer registering zone 807 may both scan 840, 845 and/or weigh 841, 846 purchased items and then place the items in the shared packing zone area, as shown by the three zone numbers 890.

At any time the cashier 804 may decide to close the ongoing combined sale in both registering zones 806, 807.

If the cashier 804 closes the combined sale the computer system 919 will stop accepting any registrations and the barrier may be moved to the centre position 861 for a split sale operation or to the opposite outer position 860, 862 for combined sales operation.

While registering two different sales in a split registration operation mode, the cashier 804 may close any of the sales and then choose to continue with doing split registrations or change to a combined registration mode, by moving the barrier 809 from the centre position to an outer position 860, 862 whereby joining the other registration in the active zone or allow a new combined registration operation to be started.

The barrier 809 may in an embodiment of the present innovation be physically locked by the computer system, by for example an electrically controlled magnet, latch or pin to optionally ensure that the barrier 809 is moved only after sales has been completed and the barrier 809 move will allow further registrations to take place into an appropriate zones 806 vs. 808 and 807 vs. 808.

Figure 11:
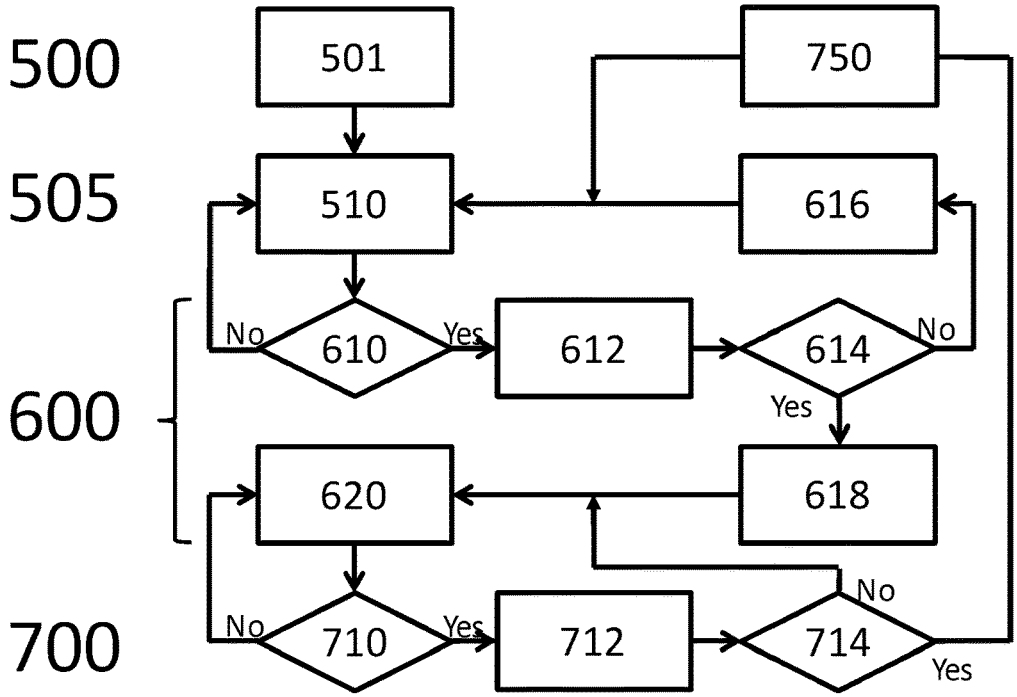
FIG. 11 shows a flow chart for operation of a checkout counter according to another embodiment of the invention.

The running operation of the checkout counter with a roundtable disc shown step by step is disclosed in FIG. 11, it includes at least the following steps:

500: Assumes sale to 890 as shown in FIG. 8*a*.

501: Start up/ready

505: A barrier move may not be needed when the packing area is not occupied in the current packing zone 808.

510: Combined register of items to shared zone 808.

600: Cashier closes the combined sale zones as shown in FIG. 8*a* (or 8*c*) changing to FIG. 8*c* if initially FIG. 8*a* change to configuration 8*a* if initially in FIG. 8*c* for a combines sales process, if it is a split sale change to configuration shown in FIG. 8*b*.

610: Complete sale? If yes continue with step 612, if no continue with step 510.

612: Close combined sales in both zones 806, 807.

614: Split zones? If yes continue with step 618, and if no continue with step 616.

616: Move barrier to opposite position 862, 860.

618: Move barrier to the centre position 861.

620: Register items to split zone(s) 808.

700: A combined sale is only possible when none or one sale is active. The inactive zone may then join the ongoing sale or create a new sale combining both zones.

710: Complete a zone? If yes continue at step 71?, if no continue with step 620.

712: Close sale in the completed zone 806, 807.

714: Combine zones? If yes continue with step 7 FIG. 1150, if no continue with step 620.

750: Move barrier to outer position 862 or 860.

Note that barrier 809 release and locking is optional.

Common features for running operation of the checkout counter with turntable packing area and standard packing area Optionally the cashier 704, 804 may manually perform registering operations on behalf of the customer 705, 805, by instructing the computer system 919 to temporarily accept registrations in the cashier zone 706, 806 to be added to the customer zone sales 707, 807 instead. This may for example allow the counter to have only a single scale 741, 841 where the cashier 704, 804 performs all scale operations.

| | |
|---|---|
| 101, 201, 601: | Loading area |
| 102, 202, 302, 602, 702, 802: | Registering/scanning area |
| 103, 203, 403, 503, 703, 803: | Packing area |
| 104, 304, 704, 804: | Cashier |
| 105, 305, 705, 805: | Customer performing registering/scanning |
| 206, 306, 406, 506, 606, 706, | Cashier registering/scanning zone |
| 207, 307, 407, 507, 607, 707, 807: | Customer registering/scanning zone |
| 208, 408, 508, 708, 808: | Packing zone(s) |
| 109, 209, 409, 509, 709, 809: | Packing zone barriers |
| 310, 410, 510, 710, 810, 910: | Payment station |
| 211, 311, 611,: | Barrier between registering zones |
| 613: | Loading zone barriers |
| 919: | Computer/processing unit |
| 140, 240, 340, 640, 740, 840, 940: | Cashier operated barcode scanner |
| 241, 341, 641, 741, 841, 941: | Cashier operated scale |
| 245, 345, 645, 745, 845, 945: | Customer operated barcode scanner |
| 246, 346, 646, 746, 846, 946: | Customer operated scale |
| 260, 460, 560, 760, 860, 960: | Cashier side packing zone barrier sensor + activator |
| 261, 461, 561, 761, 861, 961: | Center barrier packing zone barrier sensor + activator |
| 262, 362, 462, 562, 762, 862, 962: | Customer side packing zone barrier sensor + activator |
| 970 | Cashier screen/touch screen |
| 971 | Cashier keyboard/IO panel |
| 972 | Customer screen/touch screen |
| 973 | Customer keyboard/IO panel |
| 790, 890: | Sales sequence/Blue zone |
| 791, 891: | Sales sequence/Yellow zone |
| 792: | Sales sequence/Green zone |
| 793: | Sales sequence/Red zone |

The invention claimed is:

1. A checkout counter comprising:

a registration area;

a control system;

a single loading area in direct communication with two registration zones at the registration area, the single loading area being configured to forward goods downstream to the two registration zones at the registration area, wherein the registration area is adapted for independent simultaneous registration of goods at both a customer position and an operator position onto a single checkout of purchased goods, which have been registered simultaneously at both the customer position and the operator position, wherein an operator at the operator position operates the checkout counter and is responsible for a cashier terminal during the simultaneous registration of the goods by the control system at both the customer position and the operator position, wherein the registration area includes a first registration zone associated with the customer position, and a second registration zone associated with the operator position, the second registration zone being separate from the first registration zone, and the second registration zone being adjacent and parallel with the first registration zone, wherein the registration area is adapted to simultaneously register, using the control system, the goods at both the first registration zone and the second registration zone, wherein the registration area includes a packing area configured to simultaneously receive the purchased goods from both of the first registration zone and the second registration zone, and wherein either the single loading area or the packing area includes a rotatable roundtable disc with at least one barrier arranged radially from a center of the roundtable disc.

* * * * *